US005400982A

United States Patent [19]

Collins

[11] Patent Number: 5,400,982

[45] Date of Patent: Mar. 28, 1995

[54] DISPENSER FOR MULTIPLE ROLLS OF SHEET MATERIAL

[75] Inventor: Scott J. Collins, Brown Deer, Wis.

[73] Assignee: Fort Howard Corporation, Green Bay, Wis.

[21] Appl. No.: 240,072

[22] Filed: May 9, 1994

Related U.S. Application Data

[63] Continuation of Ser. No. 890,645, May 28, 1992, abandoned.

[51] Int. Cl.[6] ..... B65H 19/10; B65H 20/02

[52] U.S. Cl. ..... 242/560; 242/564.4

[58] Field of Search ..... 242/55.2, 55.3, 55.53, 242/560, 564.4, 564.1, 564.2; 312/39, 40, 34.22, 34.19

[56] References Cited

U.S. PATENT DOCUMENTS

| | | | |
|---|---|---|---|
| 3,007,650 | 11/1961 | Burton | 242/55.3 |
| 3,628,743 | 12/1971 | Bastian et al. | 242/55.3 |
| 3,650,487 | 3/1972 | Bahnsen | 242/55.3 |
| 3,700,181 | 10/1972 | Diring et al. | 242/55.3 |
| 3,771,739 | 11/1973 | Nelson | 242/55.3 |
| 3,917,191 | 11/1975 | Graham, Jr. et al. | 242/55.3 |
| 4,010,909 | 3/1977 | Bastian | 242/55.3 |
| 4,067,509 | 1/1978 | Graham, Jr. et al. | 242/553 |
| 4,106,684 | 8/1978 | Hartbauer et al. | 226/91 |
| 4,137,805 | 2/1979 | DeLuca et al. | 83/345 |
| 4,165,138 | 8/1979 | Hedge et al. | 312/39 |
| 4,203,562 | 5/1980 | DeLuca et al. | 242/55.3 |
| 4,307,638 | 12/1981 | DeLuca et al. | 83/37 |
| 4,317,547 | 3/1982 | Graham, Jr. et al. | 242/55.3 |
| 4,358,169 | 11/1982 | Filipowicz et al. | 312/39 |
| 4,396,163 | 8/1983 | Graham, Jr. et al. | 242/55.3 |
| 4,403,748 | 9/1983 | Cornell | 24/55.53 |
| 4,487,375 | 12/1984 | Rasmussen et al. | 242/55.3 |
| 4,552,315 | 11/1985 | Granger | 242/55.3 |
| 4,756,485 | 7/1988 | Bastian et al. | 242/55.3 |
| 4,807,824 | 2/1989 | Gains et al. . | |
| 4,856,724 | 8/1989 | Jespersen | 242/55.3 |
| 4,944,466 | 7/1990 | Jespersen | 242/55.3 |

*Primary Examiner*—John M. Jillions
*Attorney, Agent, or Firm*—Michael, Best & Friedrich

[57] ABSTRACT

The transfer assembly for a dispensing cabinet for dispensing wound sheet material, such as paper toweling, from a primary roll and a reserve roll includes a transfer arm having a pair of dispensing fingers under which the leading end of the sheet material from the reserve roll is disposed and a sensing arm including a sensing surface over which sheet material from the primary roll being fed into the nip between a drive roller and a pressure roller rides. The transfer arm and sensing arm are mounted for common movement between a non-transfer position wherein the sheet material riding over the sensing surface of the sensing arm, in cooperation with the pulling force being applied thereon by the drive roller, holds the transfer finger away from the nip and a transfer position wherein, in response to the tail end of the sheet material being detached from the primary roll, the transfer arm moves toward the nip and the transfer fingers push sheet material from the reserve roll into the nip. Subsequent rotation of the drive roller causes the sheet material from the reserve to be fed through the nip and dispensed from the cabinet.

6 Claims, 3 Drawing Sheets

DISPENSER FOR MULTIPLE ROLLS OF SHEET MATERIAL

This application is a continuation of Ser. No. 07/890,645, filed May 28, 1992, now abandoned.

BACKGROUND OF THE INVENTION

This invention relates to dispensers for multiple rolls of sheet material and, in one aspect, to dispensers for two rolls of paper towel.

Dispenser for rolls of flexible sheet material, such as paper towel rolls, are well known. Paper towel dispensers are widely used in public lavatories to dispense paper toweling for users to dry their hands. Such dispensers typically include either a crank or lever which the user operates to drive a feed mechanism for dispensing the paper toweling. The feed mechanism typically includes a drive roller rotated by a crank or lever or an idler or pressure roller, the paper toweling is fed through a nip between these two rollers and the pressure roller is spring loaded to provide sufficient friction for rotation of the drive roller to unwind the paper toweling off a roll core.

Some paper towel dispensing devices are capable of sequentially dispensing two rolls of paper toweling. This type dispenser includes a transfer mechanism arranged so that, when all the paper toweling from a primary roll has been dispensed, toweling from the reserve roll is introduced into the feed mechanism. One type transfer mechanisms includes a number of rollers which are arranged to provide tension between the paper toweling being unwound from the primary on the feed mechanism and, in response to loss of this tension, effect a transfer of paper toweling from the reserve roll into the feed mechanism. This loss of tension usually occurs when the tail end of the paper toweling has been completely unwound and detached from the primary roll core. However, a loss of tension occasionally can occur during normal use even though there is still paper on the primary roll. For example, if the primary roll core binds and the user is required to use additional force to operate the crank or lever, the primary roll can over run after the bind is broken loose. This can cause a slack condition which is the same as the loss tension to the transfer mechanism and it makes a false transfer, causing paper toweling from the reserve roll to be introduced into the feed mechanism. When this occurs, the feed mechanism can become jammed and no longer capable of dispensing paper toweling or simultaneously dispense paper toweling from both the primary and reserve rolls.

In another type multiple roll dispenser, the transfer assembly is a one-piece unit and includes a transfer arm having a pair of axially spaced transfer fingers and a sensing arm having a sensing surface. The transfer assembly is mounted for common pivotal movement and the sensing surface engages the outer surface of the toweling on the primary roll. The transfer assembly is arranged so that, by the time the sensing surface engages the primary roll core, the transfer arm has pivoted to a position where the transfer fingers push the leading end of the toweling from the reserve roll into the feed mechanism.

SUMMARY OF THE INVENTION

An object of the invention is to provide a simply constructed device for dispensing flexible sheet material from a roll, particularly paper toweling, including a transfer mechanism for reliably effecting sequential dispensing of toweling from a primary roll and then a reserve roll after all the toweling has been dispensed from the primary roll.

Another object of the invention is to provide such a transfer assembly which can be retrofitted into existing dispensing cabinets.

Other objects, aspects and advantages of the invention will become apparent to those skilled in the art upon reviewing the following detailed description, the drawing and the appended claims.

The invention provides an improved transfer assembly for a device for sequentially dispensing wound sheet material, such as paper toweling, from a primary roll and a secondary, which device includes a drive roller and pressure roller rotatably supported to form a nip through which the sheet material passes and means for rotating the drive roller to dispense the sheet material from the cabinet. The transfer assembly includes a transfer arm having at least one transfer finger under which a leading end portion of the sheet material from the reserve roll is disposed and a sensing arm connected to the transfer arm and having a sensing surface over which the sheet material being unrolled from the primary roll rides. The transfer and sensing arms are supported for common movement between a non-transfer position wherein the sheet material from the primary roller rides over the sensing surface of the sensing arm and, in cooperation with the pulling force applied thereon by the drive roller, holds the transfer finger away from the nip and a transfer position wherein, in response to the tail end portion of the sheet material becoming detached from the primary roll, the transfer arm moves towards the nip and the transfer finger pushes the sheet material from the secondary roll into the nip and, in response to subsequent rotation of the drive roller, causes the sheet material from the reserve roll to be fed through the nip.

DESCRIPTION OF THE PREFERRED EMBODIMENTS

Figure 1:
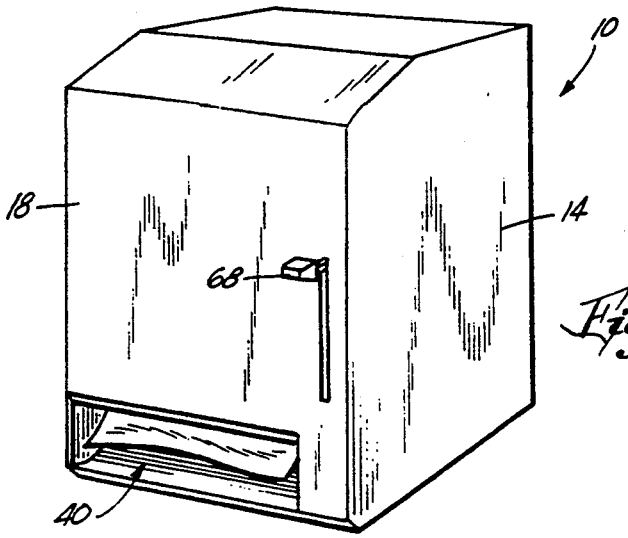
FIG. 1 is perspective view of a paper towel dispensing cabinet embodying the invention and employing an operating lever for dispensing toweling.

While the dispensing device provided by the invention can be adapted to dispense a variety of wound flexible sheet materials, it is particularly adaptable for dispensing paper towel rolls and will be described in connection with that application.

Illustrated in the drawings is a two-roll paper towel dispensing cabinet 10 having a back wall 12, opposed side walls 14, a bottom wall 16 and a cover 18 which cooperate to define a storage compartment 20 for a stub or primary roll P and a reserve roll R of paper toweling. The cover 18 is pivotally mounted on the cabinet side walls 14 by hinges or the like and can be swung downwardly to an open position to gain access to the storage compartment 20 and swung upwardly to a closed position and locked in place with a suitable lock (not shown). The reserve roll R is supported in the upper portion of the storage compartment 20 by a generally U-shaped hanger 22 including a cross member 24 suitably affixed to the cabinet back wall 12 and a pair of arms 26 extending generally perpendicular relative to the cabinet back wall 12 and transversely spaced apart a dimension approximating the width of the paper toweling to be dispensed. Mounted on the outer end portion of each arm 26 is a circular roll core holder 28 having an outside diameter approximating, but slightly less than, the inside diameter of the roll core 30 of the paper toweling to be dispensed. The roll core holders 28 preferably are molded from a synthetic plastic material having a relatively low coefficient of friction to facilitate rotation of the roll core. To install a reserve roll R, the arms 26 are spread apart far enough for a paper roll to fit therebetween and with the core aligned with the core holders 28 and then released.

The primary roll P is supported in the lower portion of the storage compartment 20 by a generally U-shaped hanger 32 which is similar to the reserve roll hanger 22 and includes a cross member 34 suitably affixed to the cabinet back wall 12 and a pair of arms 36 carrying core holders 38 arranged to function in the manner described above in connection with the reserve roll hanger 22.

Figure 2:
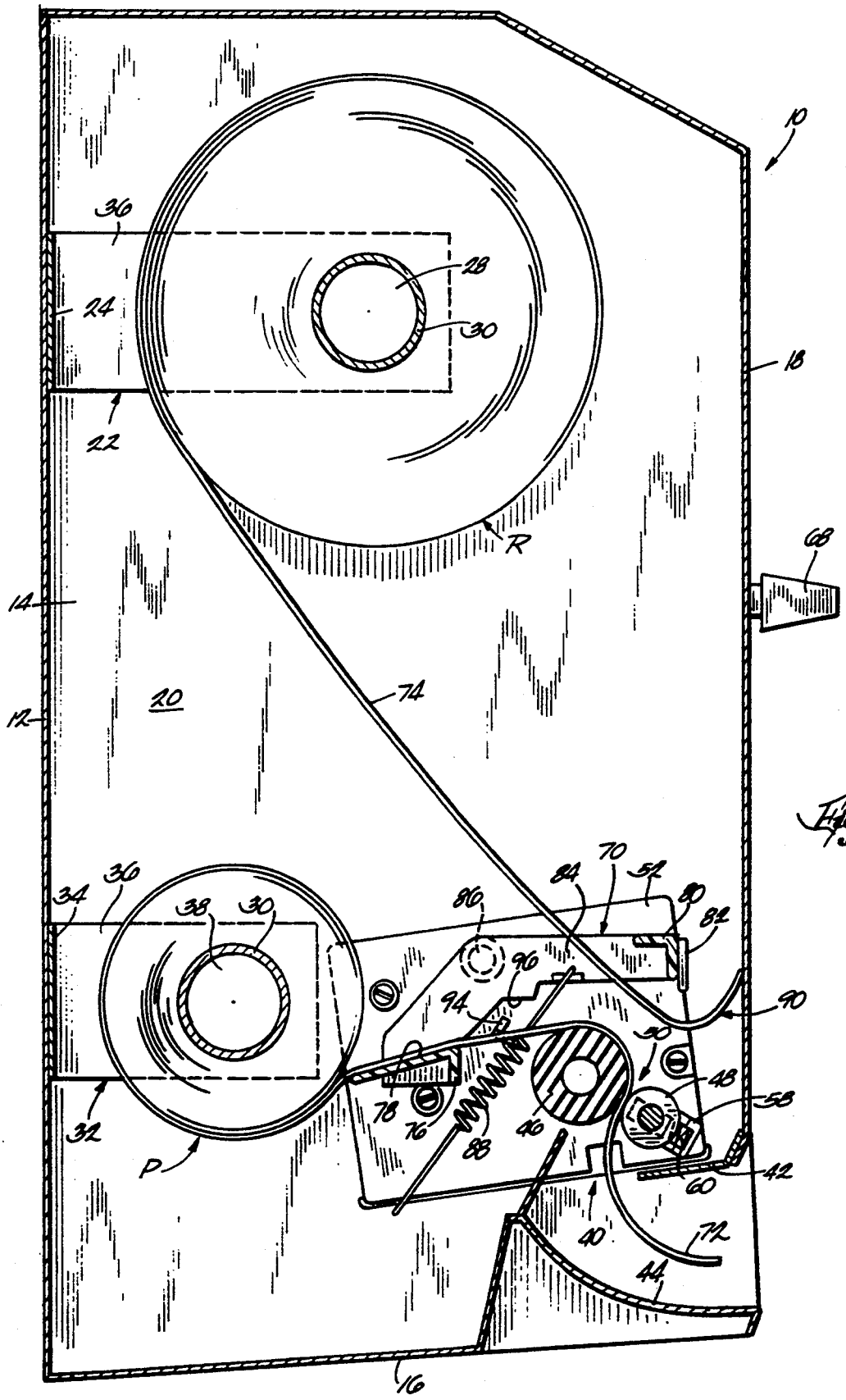
FIG. 2 is a cross sectional, side elevational view of the dispensing cabinet showing toweling being dispensed from a partially consumed primary roll with the transfer assembly in a non-transfer position.
Figure 3:
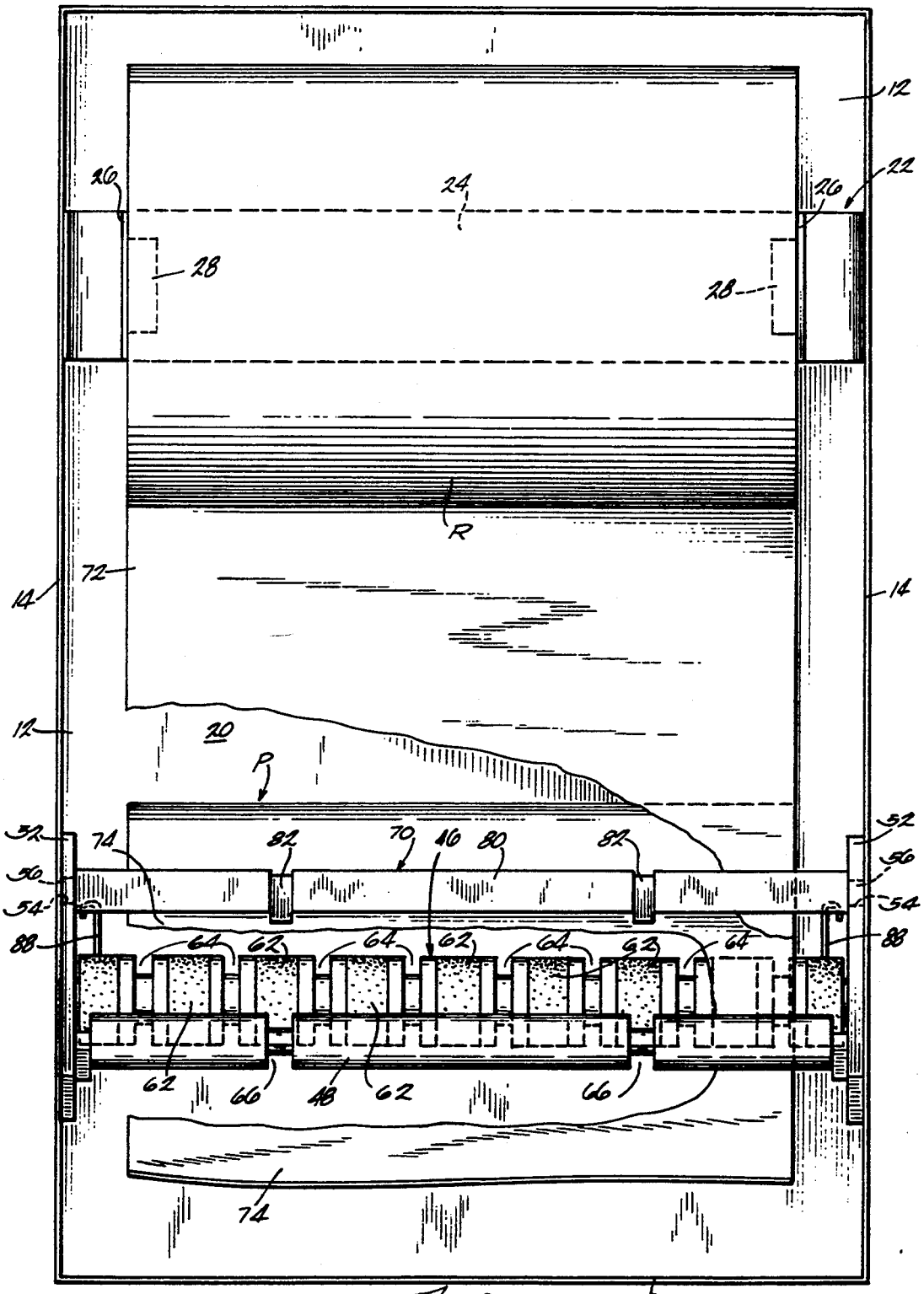
FIG. 3 is a partially broken away, front elevational view of the dispensing cabinet illustrated in FIG. 2.

As best shown in FIG. 2, paper toweling is dispensed from the cabinet 10 through a dispensing passage or opening 40 defined between the cutting edge of a cut off member or blade 42 extending transversely relative to the cabinet side walls 14 and a curvilinear wall 44 extending from the cover 18. The cut off blade 42 preferably is metal and the cutting edge has serrations or teeth so that paper toweling extending through the dispensing opening 40 can be severed by pulling upwardly.

The feed mechanism for dispensing toweling from the cabinet 10 includes a drive roller 46 and an idler or pressure roller 48 which cooperate to form a pressure nip 50 (FIG. 2), through which the paper toweling is drawn before being dispensed from the cabinet 10. The drive roller 46 and the pressure roller 48 extend transversely with respect to and are supported from the cabinet side walls 14 for rotation about respective axes which are parallel to each other and generally parallel to the rotational axes of the primary towel roll P and the reserve towel roll R. The opposite ends of the drive roller 46 are journalled in a suitable manner so that the rotational axis thereof is fixed. The opposite ends of the pressure roller 48 are mounted so that the rotational axis thereof is movable toward and away from the rotational axis of the drive roller 46.

In the specific construction illustrated, the drive roller 46 and the pressure roller 48 are supported by bearing blocks 52 mounted inside the cabinet 10. Each bearing block 52 includes an aperture 54 for rotatably receiving one end 56 of the drive roller 46. Each bearing plate 52 also includes a pocket 58 (FIGS. 2, 4 and 5) housing a coil spring 60. The springs 60 bear against the opposite ends of the pressure roller 48 and urge it into engagement with the drive roller 46 in a usual manner.

The drive roller 46 has a plurality of drive rings 62 which are made from a suitable friction material such as rubber and cooperate with the pressure roller 48 to form the pressure nip 50 through which the paper toweling is fed in a manner well known in the art. As is the usual case, the drive roller 46 can have a plurality of axially spaced, circumferentially extending recesses 64. The idler roller 48 is made from a suitable rigid material such as wood and includes a plurality of axially spaced, circumferentially extending recesses 66.

The drive roller 46 is rotated by a lever assembly which is of conventional design and has been omitted from the drawing for the sake of clarity. The lever assembly includes a drive gear (not shown) connected to one end of the drive roller 46 via a one-way clutch (not shown) and a pivotally mounted operating lever 68 including a planetary gear segment (not shown) which meshes with the drive gear. Downward movement of the operating lever 68 rotates the drive roller 46 in a clockwise direction as viewed in FIGS. 2, 4, and 5 to dispense a predetermined length of paper toweling.

The dispensing cabinet 10 includes a transfer assembly 70 which permits paper toweling 72 from the primary roll P to be fed into the nip 50 between the drive roller 46 and the pressure roller 48 and subsequently causes the paper toweling 74 from the reserve roll R to be fed into the nip 50 when at least substantially all the paper toweling has been dispensed from the primary roll P.

The transfer assembly 70, which preferably is a one-piece unit, includes a transverse sensing arm 76 extending generally parallel to the rotational axis of the primary roll P and having a sensing surface 78 and a transverse transfer arm 80 extending generally parallel to the rotational axes of the drive and pressure rollers 46 and 48 and having a pair of axially spaced, downwardly extending transfer legs or fingers 82 and web sections 84 interconnecting the opposite ends of the sensing arm 78 and the transfer arm 80. The transfer fingers 82 preferably are located to register with a pair of recesses 66 in the pressure roller 48.

Each web section 84 includes a boss 86 which fits into an aperture in a bearing block 52 for pivotal movement of the transfer assembly 70 between non-transfer and transfer positions as described in more detail below. A tension spring 88 anchored between each web section 84 and a cabinet side wall 14 urges the transfer assembly 70 in a clockwise direction as viewed in FIGS. 2, 4 and 5.

The bearing blocks 52 and the transfer assembly 70 preferably are molded from a synthetic plastic material to reduce material cost. Also, when made from such a material, there is no need for separate bearings for the drive roller 46, the pressure roller 48 or the transfer assembly 70. The bearing blocks 52 can be arranged to accommodate the drive roller and pressure roller in existing dispensing cabinets, so that the transfer assembly 70 can be installed as a retrofit. To accomplish this, the existing drive and pressure rollers, transfer mechanism, holder for the reserve roll R and holder for the primary roll P (if any) are removed from an existing dispensing cabinet. The reserve roll and primary roll hangers 22 and 32 are mounted at appropriate locations on the cabinet back wall 12 and the bearing blocks 52, with the drive and pressure rollers 46 and 48, the pressure roller springs 60 and the transfer assembly 70 in place, are fastened to the cabinet side walls 14. The transfer assembly springs 88 can be installed before or after the bearing blocks 52 are mounted.

FIG. 2 illustrates the position of the transfer assembly 70 when paper toweling 72 is being dispensed from the primary roll P and a new reserve roll R has been installed with the paper toweling ready for dispensing. When in this mode, the leading end 90 of the paper toweling 74 from the reserve roll R is threaded beneath the transfer arm 80 and the transfer fingers 82 and laid over the drive roller 46 and the pressure roller 48 adjacent the nip 50. In FIG. 2, the leading end 90 of the paper toweling 74 is shown spaced away from the nip 50 for the sake of clarity. In actual practice, it usually will lie loosely over the paper toweling 72 on the upper portion of the drive roller 46 and the pressure roller 48. The paper toweling 72 being unwound from the primary roll P rides over the sensing surface 78 of the sensing arm 76 and, in cooperation with the pulling force applied thereon by the drive rings 62 on the drive roller 46, causes the transfer assembly 70 to be rotated in a counterclockwise direction as viewed in FIGS. 2, 4 and 5 to a non-transfer position. When in this position, the transfer fingers 82 are located away from the nip 50 and permit free movement of the paper toweling 72 from the primary roll P through the nip 50.

Figure 4:
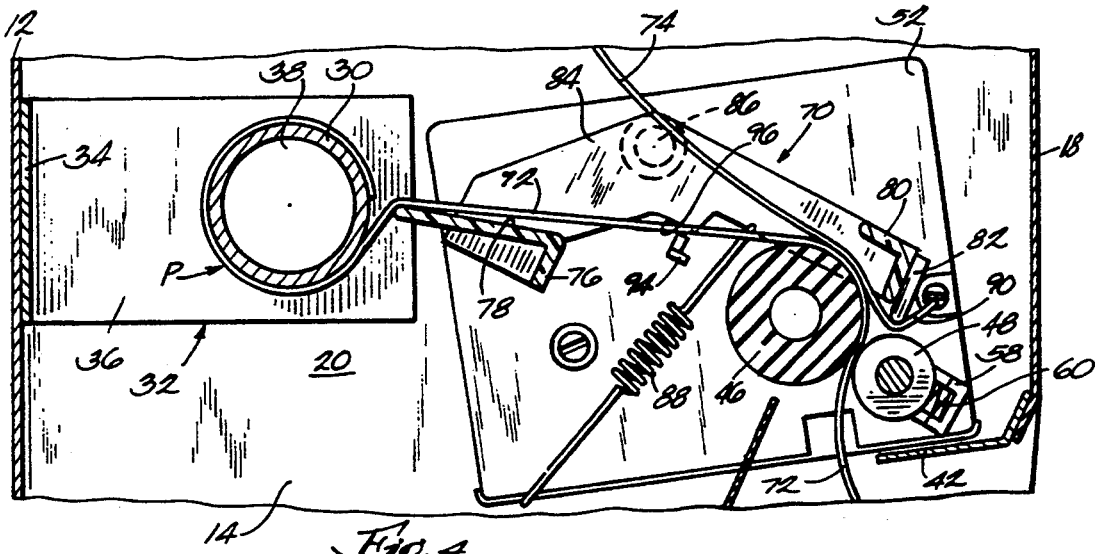
FIG. 4 is an enlarged, fragmentary, side elevational view of the dispensing cabinet with the transfer assembly in a non-transfer position shortly before transfer.
Figure 5:
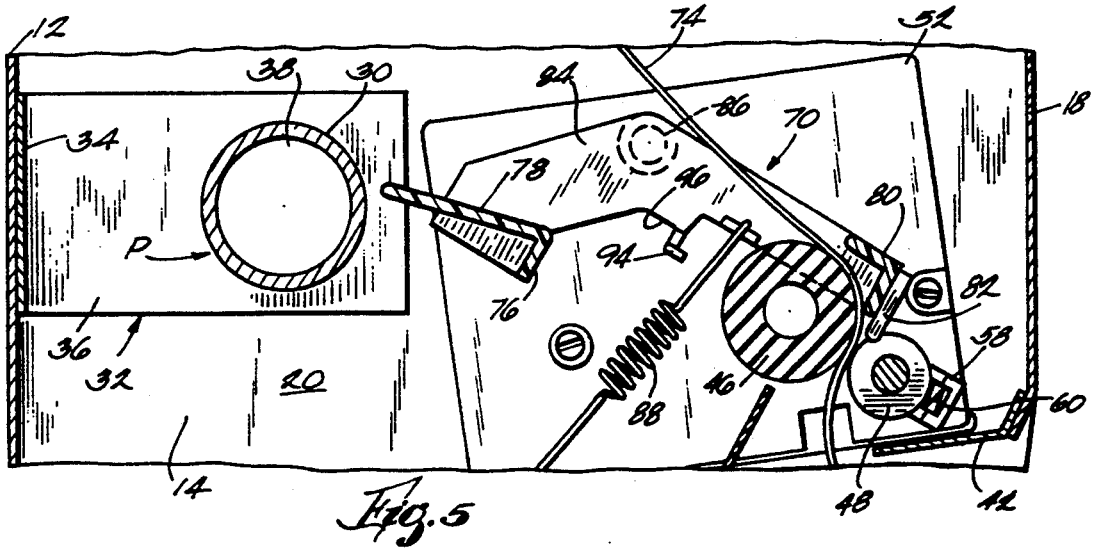
FIG. 5 is a view similar to FIG. 4 showing the transfer assembly in a transfer position after all the paper toweling has been removed from the primary roll and paper toweling is being dispensed from the reserve roll.

As paper toweling 72 is being unwound from the primary roll P, the springs 88 cause the transfer assembly 70 to slowly rotate in a clockwise direction as viewed in FIGS. 2, 4, and 5 to move the transfer fingers 82 closer to the nip 50 as best shown in FIG. 4. When the trailing end of the paper toweling 72 on the primary roll P becomes detached from the core 30 so it can no longer hold the transfer assembly 70 in a non-transfer position, the springs 88 move the transfer assembly 70 to a transfer position where the transfer fingers 82 force the leading end 90 of the paper toweling 74 from the reserve roll R into the nip 50 as they try to register with the recesses 66 in the pressure roller 48. When the transfer fingers 82 are in this position, subsequent rotation of the drive roller 46 causes the leading end 90 of the toweling 74 from the reserve roll R to be fed into the nip 50 and between the drive roller 46 and the pressure roller 48 as shown in FIG. 5. After the transfer has been made, the transfer fingers 82 are in registration with the recesses 62 in the pressure roller 48. Each bearing block 52 includes an inwardly extending projection or stop 94 which is engaged by a surface 96 on each web section 84 to limit further movement of the transfer fingers 82 into the nip 50 as illustrated in FIG. 5.

The paper toweling 72 from the primary roll P riding over the sensing surface 78 of the sensing arm 76 is maintained taut by the sensing arm 76 in combination with the friction applied on the paper toweling by the drive rings 62 on the drive roller 46. Each time the drive roller 46 is rotated to dispense toweling 72 from the primary roll P, the toweling applies a downward force on the sensing arm 76 which causes the transfer assembly 70 to rotate in a counterclockwise direction as viewed in FIGS. 2, 4 and 5 and move the transfer fingers 82 away from the nip 50. This action prevents the transfer fingers 82 from pushing the leading end 90 of the toweling 74 from the reserve roll R into the nip 50 and cause toweling to be dispensed from both the primary roll P and reserve roll R at the same time. Also, this action prevents the transfer fingers 82 from effecting a transfer to the reserve roll R until all the toweling 72 has been removed from the primary roll P. That is, as long as there is toweling on the primary roll P, the transfer fingers 82 continue to be moved away from the nip 50 each time toweling is dispensed.

In a typical field situation, an attendant, upon discovering that the primary roll P has been depleted after opening the cover 18, removes the empty primary roll core 30 from the primary roll hanger 32, removes the reserve roll R from the reserve roll holder 22 and, with the free end of the toweling 74 still threaded between the driver roller 46 and the pressure roller 48, installs the partially used reserve roll R on the primary roll hanger 32, installs a new roll on the reserve roll hanger 22 and threads the leading end 90 of the new reserve roll R beneath the transfer arm 80 and the transfer fingers 82 as illustrated in FIG. 2.

From the foregoing description, it can be seen that the transfer assembly provided by the invention is simply constructed and can be made from an inexpensive, and yet durable, material for economical manufacture and assembly. It is arranged so that each time paper toweling is dispensed, a positive action is effected to move the transfer fingers away from the nip. The transfer assembly can be arranged so it can be conveniently retrofitted into existing dispensing cabinets.

From the foregoing description, one skilled in the art can easily ascertain the essential characteristics of the invention and, without departing from the spirit and scope thereof, make various changes and modifications to adapt it to various usages.

I claim:

1. In a dispenser cabinet having a housing which includes upper and lower portions and houses means for sequentially dispensing wound sheet material from a primary roll and a reserve roll including a drive roller and a pressure roller rotatably supported to form a nip through which the sheet material passes, means rotatably supporting the primary roll with the sheet material therefrom extending through the nip, means for supporting the reserve roll with the leading end portion of the sheet material therefrom extending adjacent the nip and overlaying the sheet material from the primary roll, means for rotating said drive roller to dispense the sheet material from the cabinet and a transfer assembly for permitting sheet material from the primary roll to be fed into the nip and for subsequently causing the sheet material from the reserve roll to be fed between the nip when at least substantially all the sheet material has been dispensed from the primary roll, the improvement comprising said transfer assembly including a one-piece transfer unit including a transfer arm having opposite ends and extending transversely and generally parallel to the rotational axes of the drive and pressure rollers, at least one transfer finger extending downwardly from said transfer arm under which the leading end portion of the sheet material from the reserve roll is disposed, a sensing arm having opposite ends and extending transversely and generally parallel to the rotational axis of the primary roll and having a sensing surface facing upwardly relative to the upper portion of the cabinet housing and over which the sheet material being unrolled from the primary roll rides, and a web section interconnecting each end of said transfer and sensing arms;

means supporting said transfer unit for pivotal movement between a non-transfer position wherein said transfer finger is spaced away from the nip and a transfer position wherein said transfer finger is disposed to push the sheet material from the reserve roll into the nip and, in response to subsequent rotation of said drive roller, causes the sheet material from the reserve roll to be fed through the nip; and spring means for applying a biasing force on and urging said transfer unit toward the transfer position wherein said sheet material from the primary roll riding over the sensing surface of said sensing arm and cooperating with a pulling force applied on such sheet material by said drive roller applies a downward force on said sensing arm to overcome the biasing force of said spring means and holds said transfer unit in a non-transfer position and whereby, in response to the tail portion of the sheet material being detached from the primary roll, said spring means moves said transfer unit to the transfer position.

2. A dispenser cabinet according to claim 1 wherein at least one of said drive roller and said pressure roller includes a circumferentially extending recess; and the transfer finger on said transfer arm is registrable with said recess.

3. A dispenser cabinet according to claim 1 wherein the cabinet housing has opposed side walls; and said support means includes pivot means supporting said web sections from the side walls of the cabinet housing for relative pivotal movement of said transfer unit between the non-transfer and transfer positions.

4. A dispenser cabinet according to claim 2 wherein said pressure roller includes a pair of said recesses at axially spaced locations; and said transfer arm includes a pair of said transfer fingers registrable with said recesses in said pressure roller.

5. In a dispensing cabinet having a housing which includes upper and lower portions and houses means for sequentially dispensing wound sheet material from a primary roll and a reserve roll including a drive roller and a pressure roller rotatably supported to form a nip through which the sheet material passes, means rotatably supporting the primary roll with the sheet material therefrom extending through the nip, means supporting the reserve roll with a leading end portion of the sheet material therefrom extending adjacent the nip and overlying the sheet material from the primary roll, means for rotating said drive roll to dispense the sheet material from the cabinet and a transfer assembly for permitting said sheet material from the primary roll to be fed into the nip and for subsequently causing the sheet material from the reserve roll to be fed between the nip when at least substantially all the sheet material has been dispensed from the primary roll, the improvement comprising said pressure roller including a pair of axially spaced, circumferentially extending recesses;

said transfer assembly comprising a one-piece transfer unit including a transfer arm having opposite ends and extending transversely generally parallel to the rotational axes of said drive and pressure rollers, a pair of axially spaced transfer fingers extending downwardly from said transfer arm which are registrable with the recesses in said pressure roller and under which a leading end portion of the sheet material from the reserve roll is disposed, a sensing arm having opposite ends and extending transversely and generally parallel to the rotational axis of the primary roll, said sensing arm having a sensing surface facing upwardly relative to the upper portion of the cabinet housing and over which the sheet material being unrolled from the primary roll rides, and a web section interconnecting each end of said transfer and sensing arms;

means supporting said transfer unit for pivotal movement between a non-transfer position wherein said transfer fingers are spaced away from the nip and a transfer position where said fingers are disposed to push the sheet material from the reserve roll into the nip and, in response to subsequent rotation of said drive roller, causes the sheet material from the second roll to be fed through the nip; and spring means for applying a biasing force on and urging said transfer unit toward the transfer position whereby sheet material from the primary roll riding over the sensing surface of said sensing arm and cooperating with a pulling force applied on such sheet material by said drive roller applies a downward force on said sensing arm to overcome the biasing force of said spring means and holds said transfer arm in a non-transfer position and whereby, in response to the tail portion of the sheet material being detached from the primary roll, said spring means moves said transfer unit to the transfer position.

6. A dispensing cabinet according to claim 5 wherein the cabinet housing has opposed side walls; and said support means includes pivot means supporting said web sections from the side walls of the cabinet housing for relative pivotal movement of said transfer unit between the non-transfer and transfer positions.

* * * * *